US010353318B2

(12) United States Patent
Yokoyama et al.

(10) Patent No.: US 10,353,318 B2
(45) Date of Patent: Jul. 16, 2019

(54) DEVELOPER-SUPPLYING CONTAINER

(71) Applicants: KABUSHIKI KAISHA TOSHIBA, Tokyo (JP); TOSHIBA TEC KABUSHIKI KAISHA, Tokyo (JP)

(72) Inventors: Noriyuki Yokoyama, Susono Shizuoka (JP); Eiji Gumbe, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 15/788,247

(22) Filed: Oct. 19, 2017

(65) Prior Publication Data

US 2018/0039202 A1 Feb. 8, 2018

Related U.S. Application Data

(63) Continuation of application No. 15/222,081, filed on Jul. 28, 2016, now Pat. No. 9,823,601.

(30) Foreign Application Priority Data

Aug. 12, 2015 (JP) ..... 2015-159350

(51) Int. Cl.
*G03G 15/00* (2006.01)
*G03G 15/08* (2006.01)

(52) U.S. Cl.
CPC ..... *G03G 15/087* (2013.01); *G03G 2215/085* (2013.01); *G03G 2215/0827* (2013.01)

(58) Field of Classification Search
CPC ..... G03G 15/0865; G03G 15/0877; G03G 15/0886; G03G 15/0889; G03G 15/0875; G03G 15/0868
See application file for complete search history.

(56) References Cited

U.S. PATENT DOCUMENTS

2001/0008591 A1 7/2001 Kaneshige et al.
2004/0126131 A1* 7/2004 Numagami ..... G03G 15/0894 399/109
2008/0145109 A1 6/2008 Murayama et al.
2009/0087226 A1 4/2009 Yamazaki et al.
2013/0259495 A1 10/2013 Ota
2015/0205227 A1 7/2015 Yokoyama et al.
(Continued)

FOREIGN PATENT DOCUMENTS

JP 2009-86504 A 4/2009

OTHER PUBLICATIONS

Notification of Reasons for Refusal dated Feb. 19, 2019 in corresponding Japanese Patent Application No. 2015-159350 with machine English translation, 7 pages.

*Primary Examiner* — Walter L Lindsay, Jr.
*Assistant Examiner* — Jessica L Eley
(74) *Attorney, Agent, or Firm* — Kim & Stewart LLP

(57) ABSTRACT

According to an embodiment, a toner cartridge for use with an image forming apparatus includes a body that contains toner and includes an opening through which the toner is supplied the image forming apparatus. A supplying mechanism is provided with the body that discharges the toner from the opening of the body to the image forming apparatus. The body is removably mounted on an mounting unit of the image forming apparatus through a port.

13 Claims, 8 Drawing Sheets

(56) References Cited

U.S. PATENT DOCUMENTS

2015/0301480 A1* 10/2015 Okuda ..... G03G 15/0889
399/263
2015/0355579 A1* 12/2015 Leemhuis ..... G03G 15/0865
399/262

* cited by examiner

DEVELOPER-SUPPLYING CONTAINER

CROSS-REFERENCE TO RELATED APPLICATIONS

This application is a continuation of U.S. patent application Ser. No. 15/222,081, filed on Jul. 28, 2016, which is based upon and claims the benefit of priority from the prior Japanese Patent Application No. 2015-159350, filed on Aug. 12, 2015, the entire contents of each of which are incorporated herein by reference.

FIELD

An embodiment described here generally relates to a developer-supplying container that supplies an image forming apparatus with developer.

BACKGROUND

An image forming apparatus includes a developing device that contains developer. The developer includes a carrier and toner. The developing device supplies the toner as the developer onto a surface of a photosensitive drum, to thereby visualize an electrostatic latent image formed on a surface of the photosensitive drum. The toner is supplied by a toner hopper to the developing device. The toner hopper stores the toner and supplies the toner to the developing device.

Meanwhile, for filling the developing device with the developer, the toner hopper is removed from the image forming apparatus and a developer-supplying container is instead mounted on the image forming apparatus, for example.

A developer cartridge 300 as a typical developer-supplying container is shown in FIG. 8. A serviceman mounts the developer cartridge 300, which is filled with developer, on an image forming apparatus. The developer cartridge 300 is mounted on the image forming apparatus such that the developer cartridge 300 is located above the developing device and that an outlet port 304 serving as a developer-supplying port and an inlet port of the developing device into which the developer is fed are joined with each other. The developer filling a developer-containing section 313 of the developer cartridge 300 is stirred by a paddle 302 rotating about a shaft 310. The paddle 302 is rotated by power from a motor inside the image forming apparatus.

There is a conveying chamber 312 below the developer-containing section 313. The conveying chamber 312 includes an auger 303. The developer stirred with the paddle 302 flows down into the conveying chamber 312 by gravity. Note that, although not shown in FIG. 8, there is a partition between the developer-containing section 313 and the conveying chamber 312, the partition being opened on the front side of the drawing sheet. The developer flows into the conveying chamber 312 from the developer-containing section 313 through the opening of the partition.

By the auger 303 rotating about the shaft 311, the developer in the conveying chamber 312 is conveyed to the outlet port 304. The developer conveyed to the outlet port 304 falls by gravity and is supplied to the developing device located below the outlet port 304.

After the supply of the developer to the developing device is terminated, the serviceman removes the developer cartridge 300 from the image forming apparatus.

In a typical developer cartridge, the amount of developer supplied to the developing device depends on the amount of rotation and pitch of the auger. Further, the typical developer cartridge uses the auger serving as a developer-conveying mechanism. Therefore, depending on the amount of developer supplied to the developing device, it takes a lot of time to supply the developer.

DETAILED DESCRIPTION

Figure 1:
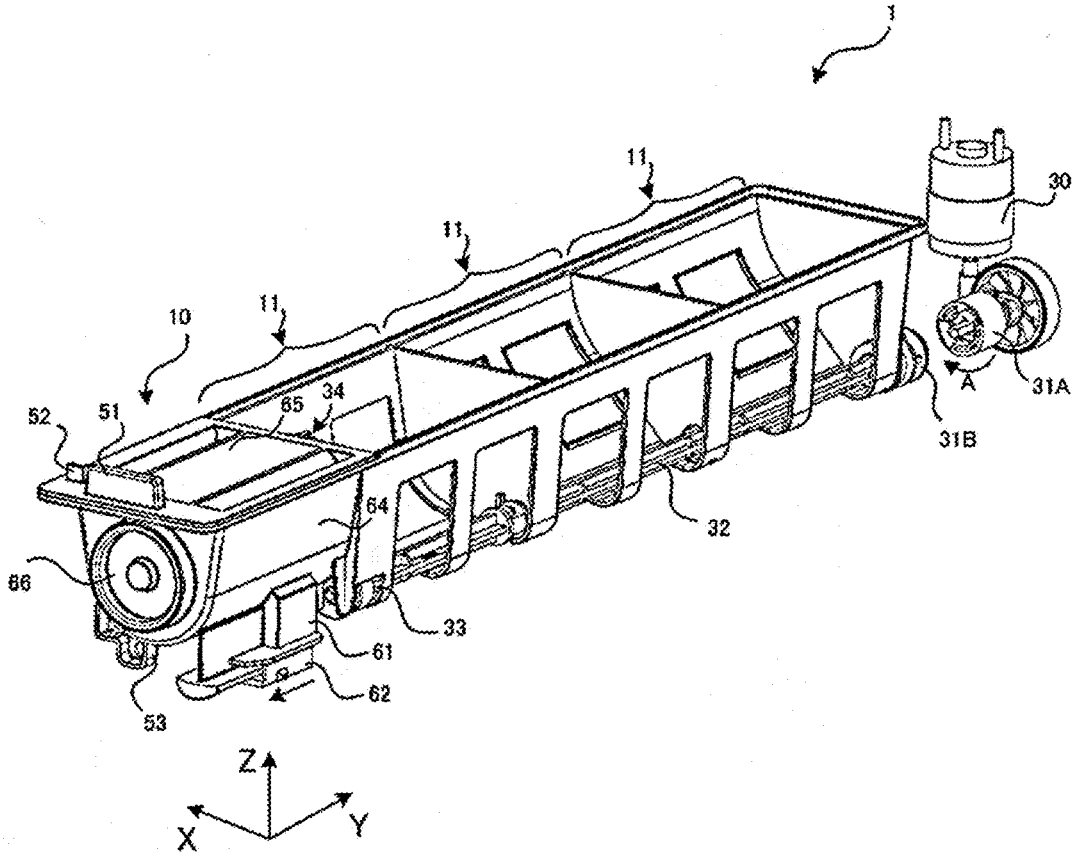
FIG. 1 is a front perspective view showing the developer cartridge according to an embodiment.

According to an embodiment, a developer-supplying container supplies an image forming apparatus that forms an image using developer, with the developer. The developer-supplying container includes a container and a paddle. The container contains the developer. The container includes an opening for supplying the image forming apparatus with the developer. The paddle conveys the developer to the opening by rotating about a shaft within the container. The paddle includes a first arm that rotates together with the paddle. The first arm has a shape that is wider on an upstream side in a direction of the rotation of the paddle and narrower toward a downstream side. The first arm is disposed such that a narrowest portion of the first arm is located at the same position as the opening in a direction of the shaft. Hereinafter, an embodiment will further be described with reference to the drawings. In the drawings, the same reference symbols show the same or similar parts.

Figure 2:
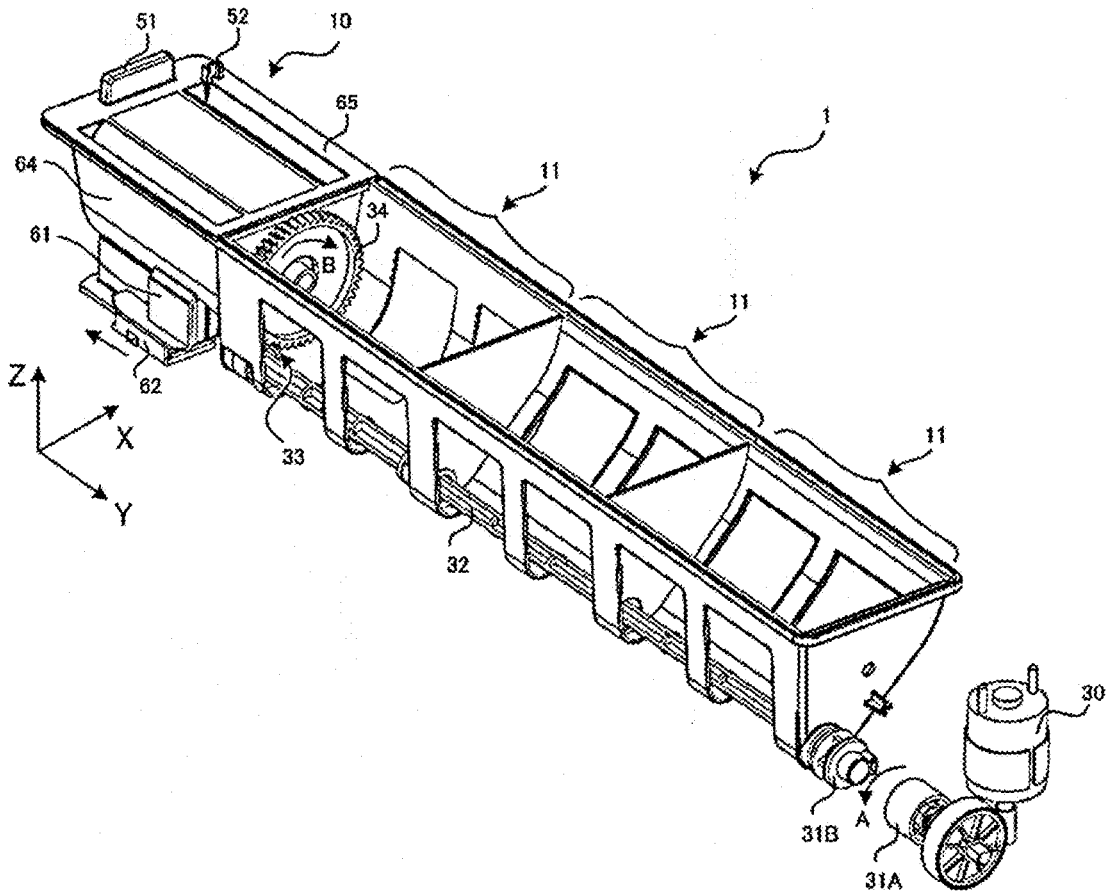
FIG. 2 is a rear perspective view showing a developer cartridge according to the embodiment.
Figure 3:
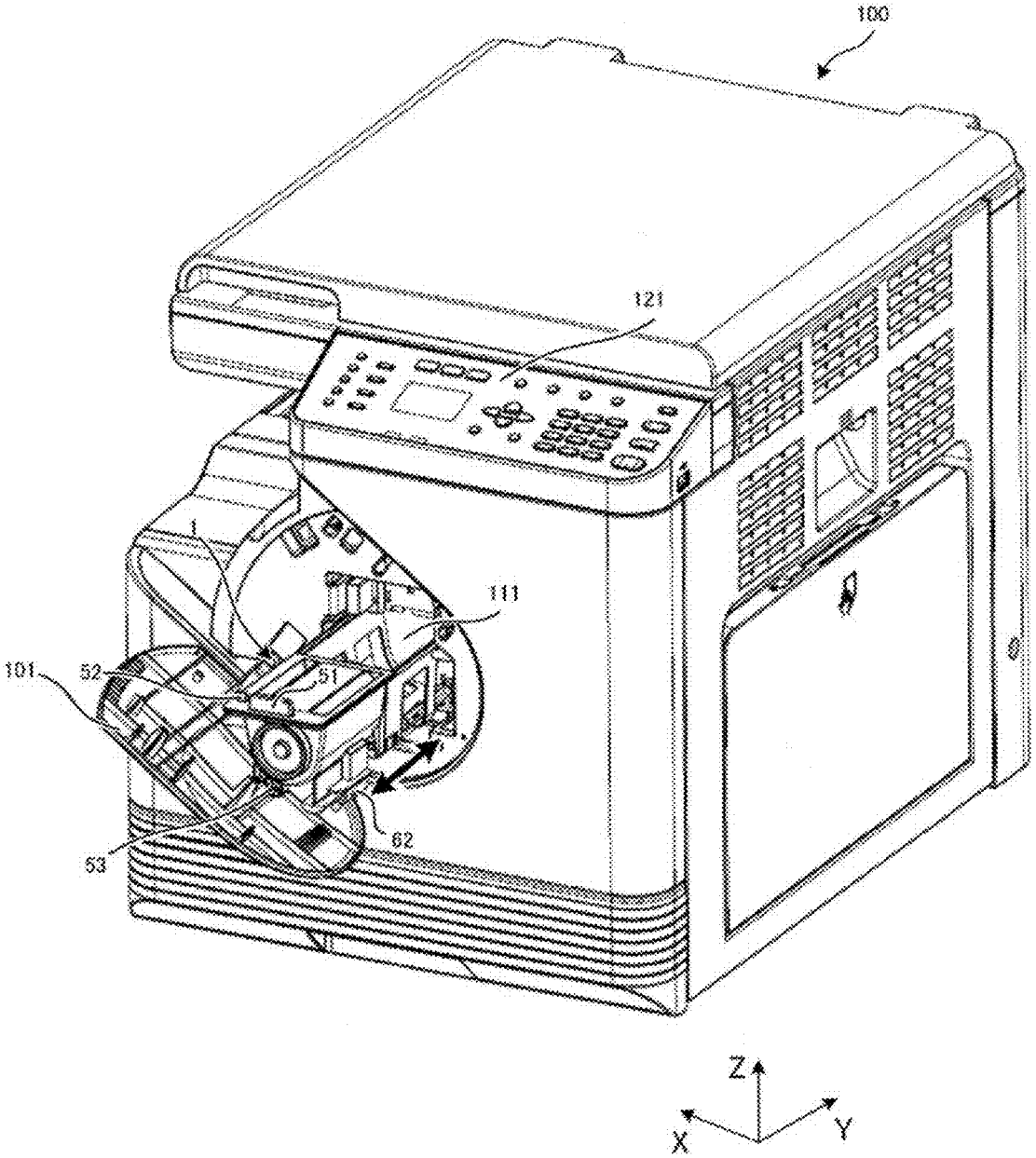
FIG. 3 is a perspective view showing an attachment/detachment position and an attachment/detachment direction of the developer cartridge according to the embodiment in an image forming apparatus.

FIG. 1 is a perspective view of a developer cartridge 1 according to the embodiment and a motor 30, which is provided in an image forming apparatus 100, as viewed from the front. The developer cartridge 1 is coupled to the image forming apparatus 100. The front refers to a side on which a serviceman operates the image forming apparatus 100, for example. FIG. 2 is a perspective view of the developer cartridge 1 and the motor 30 shown in FIG. 1, as viewed from the back. Further, FIG. 3 is a diagram showing a state when the developer cartridge 1 is mounted and removed on/from the image forming apparatus 100. Note that directions (X-axis, Y-axis, Z-axis) of a coordinate system shown in the figures are common. The X-axis is a short-side direction of the developer cartridge 1. The Y-axis is a long-side direction of the developer cartridge 1. Further, the Y-axis is a direction of a rotating shaft of a paddle 20 to be described later and is a direction in which the developer cartridge 1 is inserted into the image forming apparatus 100. The Z-axis is a height direction of the developer cartridge 1.

The developer cartridge 1 is a developer-supplying container. The developer-supplying container contains developer to be filled in the developing device, and supplies the developing device with the developer. The developer includes toner and a carrier. As shown in FIGS. 1 and 2, the developer cartridge 1 includes a developer-containing section 10 and a plurality of spacers 11. The developer-containing section 10 includes, as will be described later, a containing chamber 64 for containing the developer, the paddle 20 that conveys the developer for supplying the developer to the developing device, and the like. The spacers 11 are portions for setting the outer shape of the developer cartridge 1 to be approximately the same shape as a toner cartridge 201 to be described later. The spacers 11 has, as a whole structure, only a framework formed of frames and partition plates partitioning the spacers. That is, the spacers 11 form three empty chambers by being partitioned by the partition plates as shown in the figure. Although the three spacers 11 are shown in the figure, the number of spacers 11 is not limited thereto. The spacers 11 may have any structure as long as the outer shape of the developer cartridge 1 can be identical to the shape of the toner cartridge 201.

The developer-containing section 10 includes a container (container portion) that contains the developer and an upper lid 65. The container 64 and the upper lid 65 form the outer shape of the developer-containing section 10. The container 64 is a container portion that contains the developer. A handle bar 51 is provided on an upper surface of the upper lid 65. The handle bar 51 is a portion that is grasped by the serviceman when the developer cartridge 1 is taken out from the image forming apparatus 100. Further, a lock member 52 is provided on the upper surface of the upper lid 65. The lock member 52 is a portion that locks and fixes the developer cartridge 1 to the image forming apparatus 100 when the developer cartridge 1 is mounted on the image forming apparatus.

A developer-feeding port 66 is located in a wall surface (X-Z plane) of the container 64. Note that the developer-feeding port 66 is closed with a lid in FIG. 1. The developer-feeding port 66 is an opening for feeding developer, which is contained in a bottle, into the container 64 of the developer-containing section 10. Note that, during manufacture, the developer is fed into the container 64 through the developer-feeding port 66 and then the developer-feeding port 66 is closed with the lid. Further, as shown in FIG. 2, the container 64 includes a first gear 34 for transmitting power from the motor 30, on a wall surface opposite to the wall surface including the developer-feeding port 66 (see FIG. 2).

A positioning member 53 is located at the bottom of the container 64. The positioning member 53 restricts a position at which the developer cartridge 1 is inserted into the image forming apparatus 100. Further, an outlet port 61 is located near the bottom of the container 64 as will be described later. The outlet port 61 is an opening for supplying the developer, which is contained in the container 64, to the developing device. The developing device of the image forming apparatus includes a developer inlet port that is an opening through which the developer is supplied to the developing device. The outlet port 61 is joined with the developer inlet port. The outlet port 61 is opened and closed by a movable shutter 62. The shutter 62 is movable along a Y-axis direction between a position to close the outlet port 61 (hereinafter, referred to as closed-state position) and a position to open the outlet port 61 (hereinafter, referred to as opened-state position). The shutter 62 is moved to the opened-state position along with insertion of the developer cartridge 1 into the image forming apparatus for supplying the image forming apparatus with the developer, and moved to the closed-state position along with removal of the developer cartridge 1 from the image forming apparatus. The shutter 62 closes the outlet port 61 by being moved in an arrow direction shown in FIG. 1, for example, and opens the outlet port 61 by being moved in a direction opposite to the arrow direction shown in FIG. 1.

A shaft member 32 that transmits the power from the motor 30 to the first gear 34 is provided along the Y-axis direction to penetrate the spacers 11 at the inner bottoms of the spacers 11.

The motor 30 is a driving source for the developer cartridge 1 and is also a driving source for the toner cartridge 201 to be described later. The motor 30 is fixed at a predetermined position inside the image forming apparatus 100. A coupling 31B provided at one end portion of the shaft member 32 is coupled to a coupling 31A provided in a rotational driving unit of the motor 30 when the developer cartridge 1 is mounted on the image forming apparatus 100. Further, a second gear 33 is provided at the other end portion of the shaft member 32. The second gear 33 meshes with the first gear 34 and has a smaller diameter than that of the first gear 34.

Power transmission from the motor 30 will be described with reference to FIGS. 1 and 2. The coupling 31A is rotated by power from the motor 30, in an arrow-A direction shown in FIG. 1. With this rotation, the shaft member 32 and the second gear 33 are rotated in the same arrow-A direction as the coupling 31A. The first gear 34 meshing with the second gear 33 is rotated in a direction (arrow B of FIG. 2) opposite to the rotation direction of the second gear 33, to thereby rotate the paddle 20 within the container 64 to be described later. With this, the paddle 20 is rotated in the same direction as the first gear 34 and conveys the developer, which is contained in the container 64, to the outlet port 61.

Mounting and removing the developer cartridge 1 on/from the image forming apparatus 100 will be described with reference to FIG. 3. The developer cartridge 1 is mounted on the image forming apparatus 100 from a front wall surface of the image forming apparatus 100 in which an operation panel 121 is provided, that is, a wall surface on a front side of a main body of the image forming apparatus 100. The developer cartridge 1 is insertable and removable in the Y-axis direction.

There are provided a take-in/take-out port 111 and a take-in/take-out port cover 101 in a wall surface on the front side of the main body of the image forming apparatus 100. The take-in/take-out port 111 is used for taking in and taking out the developer cartridge 1. The take-in/take-out port cover 101 covers the take-in/take-out port 111. When the take-in/take-out port cover 101 is manually opened, the take-in/take-out port 111 is exposed. The take-in/take-out port 111 communicates with a mounting unit on which the toner cartridge 201 and the developer cartridge 1 are removably mounted.

The serviceman inserts the developer cartridge 1 into the mounting unit by pushing the developer cartridge 1 into the image forming apparatus 100 through the take-in/take-out port 111. When the developer cartridge 1 is inserted by some extent, the positioning member 53 is fitted into a part of the image forming apparatus 100 and at the same time the lock member 52 is engaged with a hook (not shown) of the image forming apparatus 100. With this, the developer cartridge 1 is fixed to the mounting unit in the image forming apparatus 100 and coupled also to the motor 30 inside the image forming apparatus 100. Further, at this time, the shutter 62 is, at the opened-state position, brought into contact with a part of the image forming apparatus 100 and opens the outlet port 61. In the state in which the mounting of the developer cartridge 1 on the image forming apparatus is completed in this manner, the serviceman inputs, by using the operation panel 121, an instruction to fill the developing device with the developer. The developer cartridge 1 obtains the power from the motor 30 and starts an operation of supplying the developer for filling the developing device with the developer. When the operation of supplying the developer is completed, the serviceman releases the engagement between the lock member 52 and the hook, and grasps the handle bar 51 and extracts the developer cartridge 1. At this time, the engagement with the motor 30 is also released. In addition, the shutter 62 is moved to the closed-state position and closes the outlet port 61. Note that the shutter 62 is moved between the opened-state position and the closed-state position by sliding on a rail provided in the mounting unit, for example.

Figure 4:
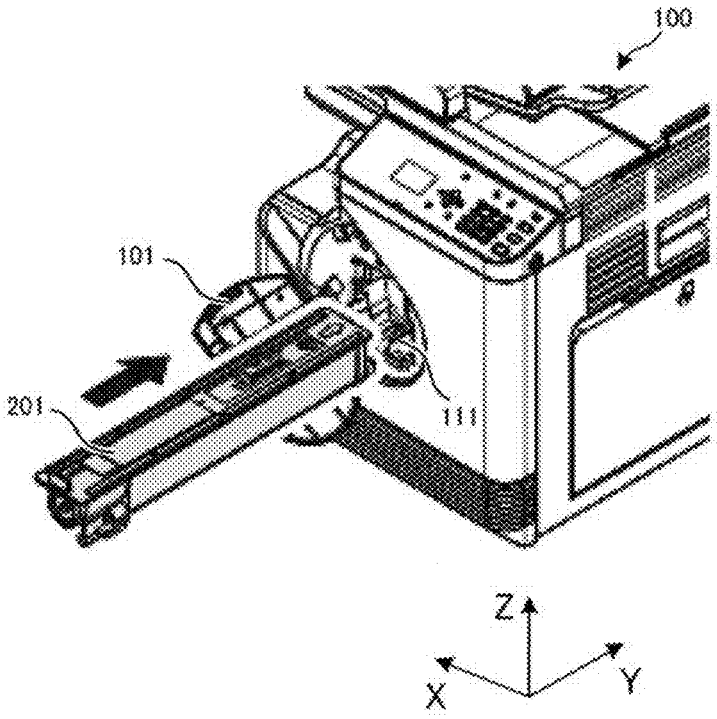
FIG. 4 is a perspective view showing a state when the developer cartridge according to the embodiment is inserted into the image forming apparatus.

In this embodiment, as shown in FIG. 4, the toner cartridge 201 having the same outer shape as the outer shape of the developer cartridge 1 is inserted from the take-in/take-out port 111 after the developer cartridge 1 is taken out. When the toner cartridge 201 is mounted on the mounting unit, the image forming apparatus 100 can perform image formation. In this embodiment, as described above, the mounting unit on which the toner cartridge 201 is mounted and the take-in/take-out port 111 are also used for mounting the developer cartridge 1 and the motor 30 for driving the toner cartridge 201 is also used for driving the developer cartridge 1. In a typical image forming apparatus, a position at which a toner cartridge is mounted and a position at which a developer cartridge is mounted are different and a take-in/take-out port for mounting and removing the developer cartridge is additionally provided. In this embodiment, the toner cartridge 201 and the developer cartridge 1 are designed to have the same outer shape, the spacers being provided on the developer cartridge 1 depending on needs. Further, in this embodiment, the developer cartridge 1 is removably mounted on the mounting unit on which the toner cartridge 201 is mounted. With this, it is possible to downsize the image forming apparatus.

Figure 5:
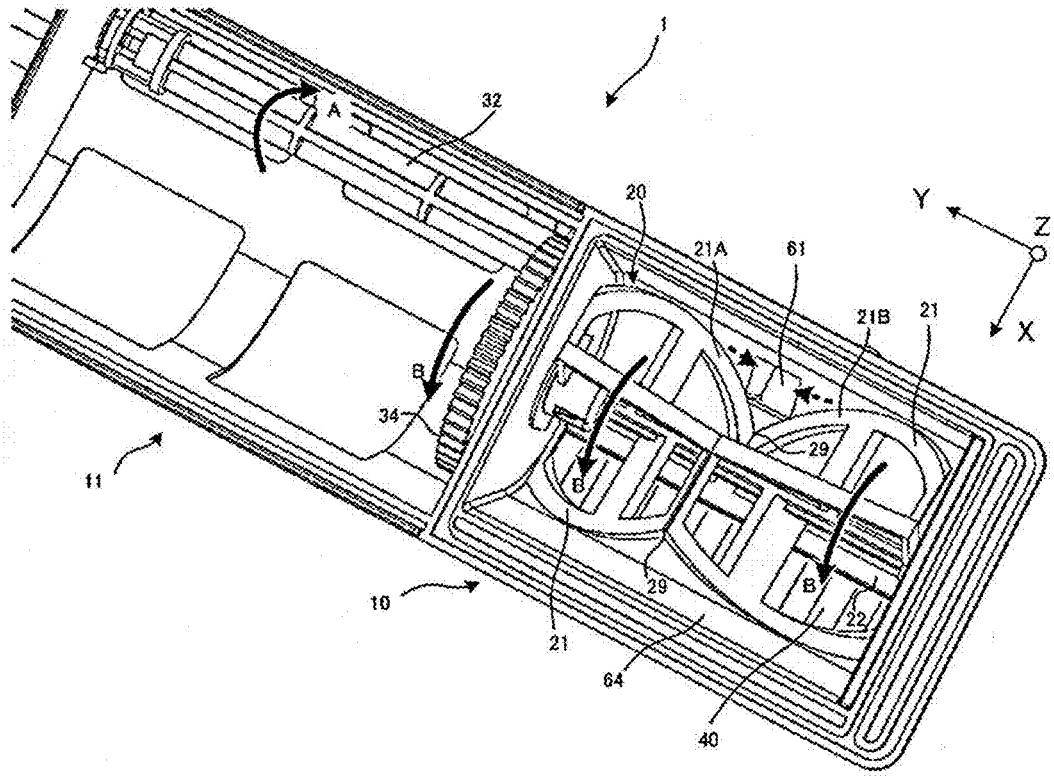
FIG. 5 is a perspective view showing an inside of a developer-containing section of the developer cartridge according to the embodiment.
Figure 6:
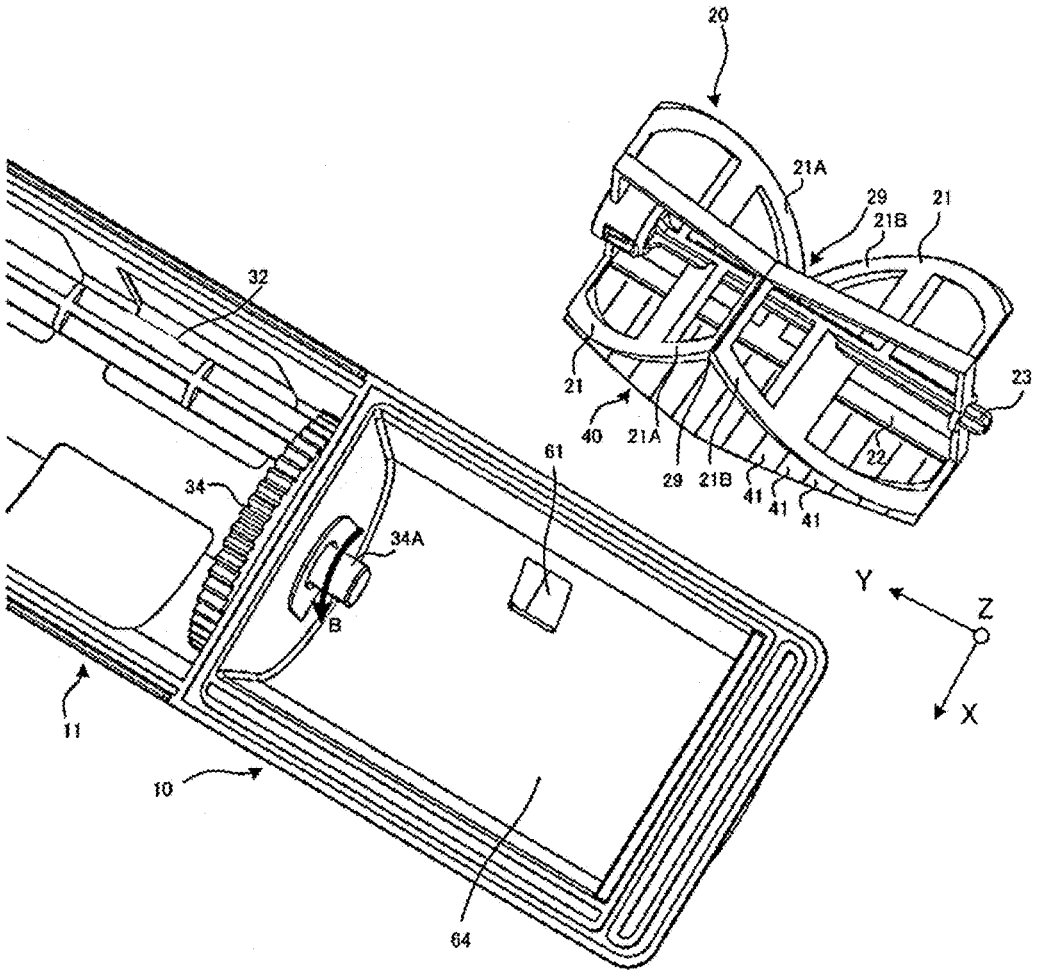
FIG. 6 is a perspective view showing a state in which a paddle is removed from the developer-containing section of the developer cartridge according to the embodiment.

Next, an inside of the developer-containing section 10 will be described with reference to FIGS. 5 and 6. FIG. 5 is a diagram showing a state in which the upper lid 65 of the developer-containing section 10 is removed. FIG. 6 is a diagram showing a state in which the paddle 20 and other mechanisms inside the developer-containing section 10 are removed. In FIGS. 5 and 6, an arrow-A direction and an arrow-B direction shown by bold solid lines are rotation directions of the members such as the paddle 20.

The developer-containing section 10 includes the paddle 20 having a V-shape. The paddle 20 is a rotating member. The significance of forming the paddle 20 in the V-shape will be first described and a detailed description will be made later. In this embodiment, the outlet port 61 of the developer-containing section 10 is provided at a position upper than the bottom of the container 64 as shown in FIGS. 5 and 6, not at the lowest portion of the container 64 in a gravitational direction, i.e., the bottom of the container 64. For using the mounting unit and the take-in/take-out port 111 of the toner cartridge 201 also as the mounting unit and the take-in/take-out port of the developer cartridge 1 as described above, it is necessary that the outlet port 61 is located at the same position as a toner discharging port of the toner cartridge 201 when the developer cartridge 1 is mounted on the mounting unit. Note that the toner discharging port of the toner cartridge 201 is an opening through which the toner is discharged from the toner cartridge 201 for supplying the toner to the developing device.

On the other hand, the toner cartridge 201 is mounted on the mounting unit and the toner is discharged from the toner cartridge 201 for supplying the developing device with the toner. At this time, for the purpose of finely adjusting the amount of toner discharged from the toner cartridge 201 (amount of toner supplied to the developing device), the toner cartridge 201 discharges the toner by moving the toner upward from the bottom of the toner cartridge 201 within the cartridge. For this reason, the toner discharging port is provided at the position upper than the bottom of the toner cartridge 201. Thus, as described above, in this embodiment, the outlet port 61 is also provided at the position upper than the bottom as in the toner discharging port.

Further, when the developer cartridge 1 is mounted on the mounting unit on which the toner cartridge 201 is mounted and the developer is supplied to the developing device, it is necessary that the entire amount of developer contained in the container 64 is rapidly discharged from the outlet port 61 and supplied to the developing device. Therefore, in this embodiment, the shape of the paddle 20 is set to the V-shape as a shape specialized for discharge of the developer from the developer cartridge 1 (supply of the developer to the developing device).

An internal configuration of the developer-containing section 10 including the paddle 20 and the like will be further described. By a shaft 23 of the paddle 20 (see FIG. 6) being fitted onto a rotating shaft 34A of the first gear 34, the first gear 34 and the paddle 20 can be rotated together. With this, the paddle 20 is rotated about the shaft 23 in the same direction (arrow B) as the first gear 34. The paddle 20 includes a pair of first arms 21 as a first conveying member. The pair of first arms 21 are arranged point-symmetrically as viewed in the direction of the shaft 23 (in Y-axis direction). Each of the first arms 21 includes two frames 21A, 21B each having a curved outer shape.

The two frames 21A, 21B are, at one ends thereof, joined with each other. A point 29 at which the one ends of the frames 21A, 21B are joined with each other is positioned at a center portion of the paddle 20 in the direction of the shaft (in Y-axis direction). The first arm 21 forms a V-shape with the point 29 being a vertex due to the two frames 21A, 21B. The two frames 21A, 21B form the V-shape as viewed in a Z-axis direction and as viewed in an X-axis direction as shown in FIGS. 5 and 6. Specifically, regarding the two frames 21A, 21B of the first arm 21, a distance between the frames is wider on an upstream side in a rotation direction B of the paddle 20 (front side in a movement direction of the first arm 21). In addition, regarding the two frames 21A, 21B, the distance between the frames is narrower toward a downstream side in the rotation direction B of the paddle 20 (rear side in the movement direction of the first arm 21) and the frames are joined with each other at the point 29. That is, the first arm 21 of the paddle 20 has a shape that is wider on the upstream side in the rotation direction of the paddle 20 and narrower toward the downstream side.

The outlet port 61 (opening) for supplying the developer to the developing device is positioned at the center portion (center portion in the Y-axis direction of the container 64) in the direction of the shaft 23 of the paddle 20 (in Y-axis direction). That is, the point 29 of the paddle 20 and the outlet port 61 are located at the same position in the direction of the shaft 23 (in Y-axis direction). In other words, a narrowest portion (point 29) of the first arms of the paddle 20 is located at the same position as the opening in the direction of the shaft.

The first arm 21 of the paddle 20 has the V-shape as described above. Thus, the first arm 21 is tilted at the above-mentioned center portion (vertex of V-shape). Thus, the developer contained in the container 64 of the developer-containing section 10 is conveyed by the paddle 20 being rotated in the arrow-B direction, and tends to be collected in a downward direction of the curved tilt, that is, toward the point 29 (broken arrow directions in FIG. 5). Here, when the point 29 comes closer to the outlet port 61 due to rotation of the paddle 20, the developer collected at the point 29 is discharged through the outlet port 61 and supplied to the developing device. In this manner, in the developer-containing section 10 according to this embodiment, by the paddle 20 being rotated in the arrow-B direction, the developer is collected to the center portion at which the outlet port 61 is positioned and then the developer is supplied to the developing device. With this configuration, it is possible for the developer-containing section 10 to supply a larger amount of developer to the developing device in a short time.

In the developer-containing section 10, the paddle 20 is not in contact with an inner wall of the container 64. In other words, there is a gap between the first arm 21 of the paddle 20 and the inner wall of the container 64. When there is a little developer in the container 64, the developer remains in this gap. The developer cartridge 1 according to this embodiment includes a conveying guide that functions as a second conveying member. The conveying guide includes a conveying plate 40. The conveying plate 40 is provided by being joined with the paddle 20, and is rotated together with the paddle 20. The conveying plate 40 scrapes and collects the developer remaining in the gap and on the inner wall of the container 64, and conveys it to the outlet port 61.

The conveying plate 40 is a thin plate member, for example. Specifically, the conveying plate 40 includes a plurality of sheet members 41 as shown in FIG. 6. One end of the conveying plate 40 is a free end and in contact with the inner wall of the container 64. Further, the paddle 20 includes a second arm 22 as a supporting member for supporting the other end of the conveying plate 40. Specifically, the other end of the conveying plate 40 is joined with to the second arm 22. A width length of the conveying plate 40 (length in the X-axis direction), that is, a length in a direction orthogonal to the direction of the shaft 23 is shorter at both end portions of the second arm 22 in the direction of the shaft 23 (in Y-axis direction) as shown in FIG. 6. In addition, the width length of the conveying plate 40 is long at the center portion of the second arm 22 in the direction of the shaft 23 as shown in FIG. 6.

Figure 7A:
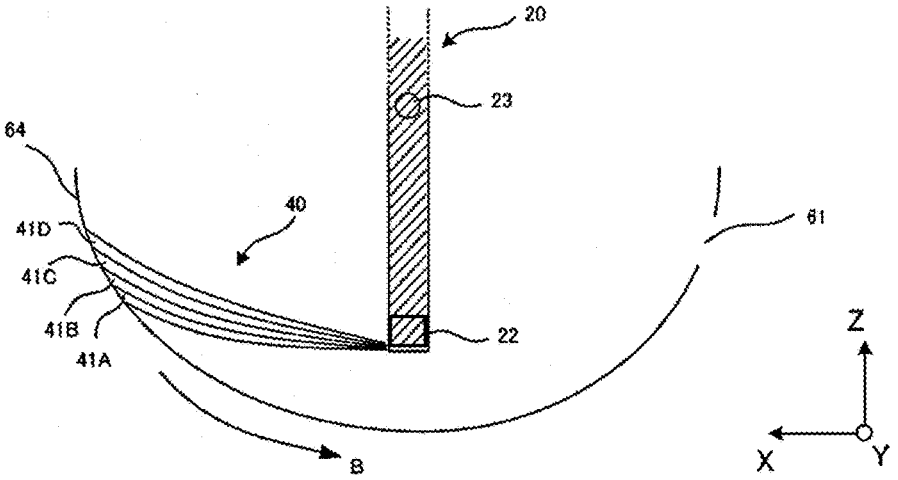
FIG. 7A is a schematic diagram for explaining a conveying plate according to an embodiment.
Figure 7B:
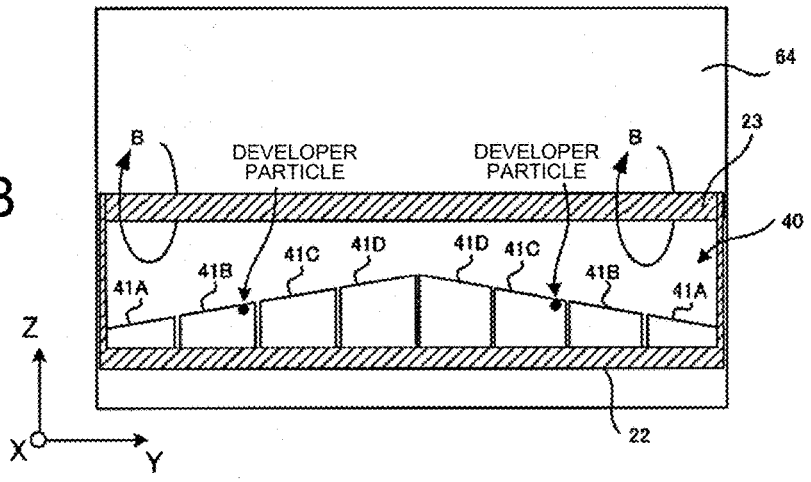
FIG. 7B is a schematic diagram for explaining the conveying plate according to the embodiment.
Figure 7C:
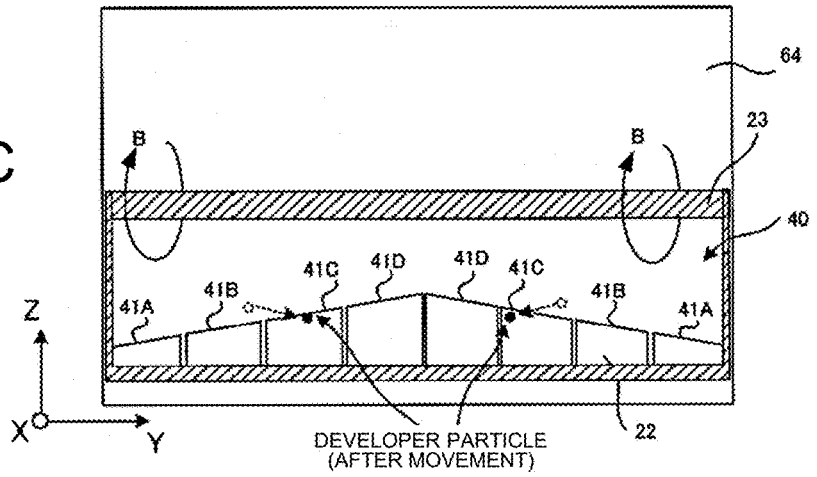
FIG. 7C is a schematic diagram for explaining the conveying plate according to the embodiment.
Figure 8:
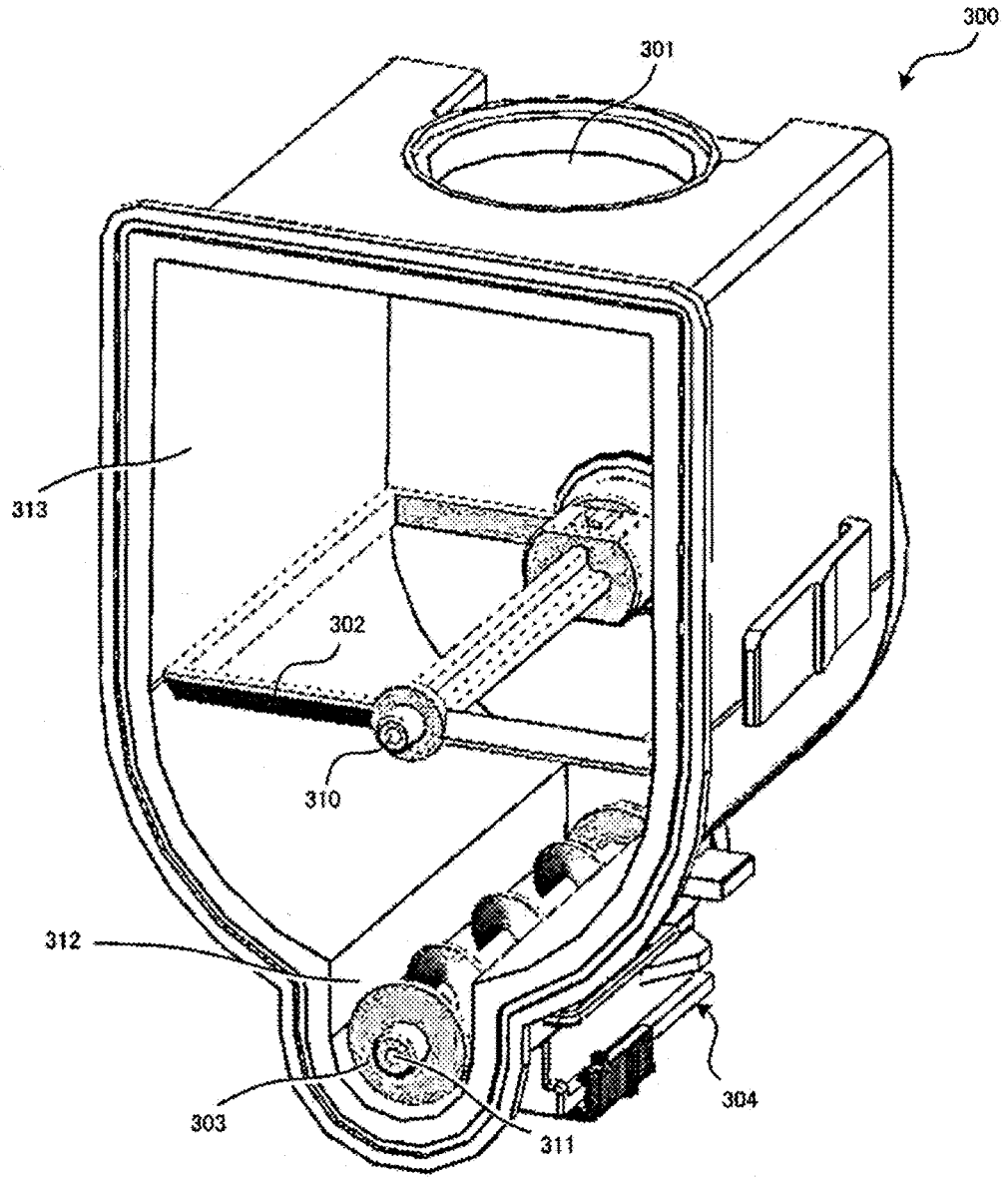
FIG. 8 is a diagram showing a typical developer cartridge.

FIG. 7A is a schematic diagram showing a part of the paddle 20 and the conveying plate 40 of the conveying guide as viewed in the Y-axis direction. FIG. 7B is a diagram for explaining how the conveying plate 40 acts on developer particles in the container 64. Specifically, FIG. 7B is a schematic diagram showing a part of the paddle 20 and the conveying plate 40 as viewed in the X-axis direction. Further, FIG. 7C is a diagram for explaining the developer particles after movement from the state shown in FIG. 7B. Specifically, FIG. 7C is a schematic diagram showing a state in which the conveying plate 40 is slightly moved downward from the state shown in FIG. 7B by the rotation of the paddle 20. Each of the sheet members 41 (41A to 41D) of the conveying plate 40 has one end in contact with the inner wall of the container 64 and the other end joined with the second arm 22 as shown in FIG. 7A. The sheet members 41A positioned at the both end portions of the conveying plate 40 are short. The sheet members 41D positioned at the center portion are long.

Contact positions between the container 64 and the sheet members 41A to 41D will be described hereinafter. As shown in FIGS. 7A and 7B, in the rotation direction shown by the arrows B, contact points of the sheet members 41A with the container 64 are positioned on a front side in the movement direction of the second arm 22 (upstream side in the rotation direction of the shaft 23). In addition, the contact points of the sheet members 41B with the container 64 are positioned on a rear wide in the movement direction of the second arm 22 (downstream side in the rotation direction of the shaft 23) in comparison with the contact points of the sheet members 41A with the container 64, and the contact points of the sheet members 41C with the container 64 are positioned on a rear wide in the movement direction of the second arm 22 (downstream side in the rotation direction of the shaft 23) in comparison with the contact points of the sheet members 41B with the container 64. Further, contact points of the sheet members 41D with the container 64, which are positioned at the center portion, are at rearmost positions in the movement direction of the second arm 22. In this manner, regarding the sheet members 41A to 41D of the conveying plate 40 and the inner wall of the container 64, the both ends of the conveying plate 40 are in contact with the inner wall of the container 64 on the front side in the movement direction of the second arm 22. In addition, the sheet members 41A to 41D and the inner wall of the container 64 are in contact with one other on the rear side in the movement direction of the second arm 22 as they are closer to the center portion of the conveying plate 40. In other words, a contact shape between the conveying plate 40 and the inner wall of the container 64 is a V-shape as viewed in the X-axis direction (see FIG. 7B).

By the paddle 20 being rotated in the arrow-B direction with the shaft 23 being a center, the conveying plate 40 joined with the second arm 22 of the paddle 20 is also rotated in the same arrow direction B as the paddle 20 with the shaft 23 being a center. A contact position of the conveying plate 40 in the inner wall of the container 64 is moved by the rotation of the conveying plate 40. Due to this rotation, the conveying plate 40 sweeps the developer on the inner wall of the container 64 in the rotation direction and collects the developer to the sheet members 41D positioned on the rear side in a rotational movement direction. Such a state will be described with reference to FIGS. 7B and 7C. FIG. 7C shows a state in which the contact position between the conveying plate 40 and the container 64 is moved downward by the rotation in the arrow-B direction from the state of FIG. 7B. The developer particles remaining in the container 64 shown in FIG. 7B are pushed by the sheet members 41A to 41D. The developer pushed by the sheet members 41A to 41D is moved to the center portion in the direction of the shaft 23 (in Y-axis direction) as in the state shown in FIG. 7C. In this manner, the developer collected to the center portion near the sheet members 41D is discharged from the container 64 at the outlet port 61 positioned at the center portion and supplied to the developing device.

As shown in FIGS. 5 and 6, in this embodiment, the outlet port 61 is provided at the center portion in the direction of the shaft 23 of the paddle 20 (in Y-axis direction) within the container 64 of the developer-containing section 10. In addition, the point 29 of the paddle 20 and the sheet members 41D located rearmost in the rotation direction of the conveying plate 40 are also at the center portion in the direction of the shaft 23 of the paddle (in Y-axis direction). As described above, all of the outlet port 61, the point 29, and the sheet members 41D are positioned at the center portion in this embodiment. However, the positions of the outlet port 61, the point 29, and the sheet members 41D are not limited to the center portion. The positions of the joining portion (point 29) of the V-shape of the paddle 20 and the sheet members 41D rearmost in the rotation direction of the conveying plate 40 only need to correspond to the position of the outlet port 61 in the direction of the shaft 23 of the paddle 20 (in Y-axis direction). In addition, the conveying plate 40 is not limited to the plurality of the sheet members 41 as shown in FIG. 7. For example, the conveying plate 40 includes one not divided into the plurality of sheet members and one partially formed as the sheet members.

Further, in this embodiment, the description has been made assuming that the one ends of the frames 21A, 21B of the paddle 20 are joined at the point 29. However, the one ends of the frames 21A, 21B of the paddle 20 do not need to be joined but may have a gap therebetween. Although the frames 21A, 21B are curved in this embodiment, the frames 21A, 21B may each have a linear shape.

As described above in detail, in accordance with the developer-supplying container according to the embodiment, it is possible to supply a large amount of developer to the developing device in a short time for filling the developing device with the developer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner cartridge and a developer-supplying container for use with an image forming apparatus on which the developer-supplying container can be mounted on a mounting unit through a port, the developer-supplying container having:

a container that contains the developer and includes an opening for supplying the image forming apparatus with the developer, a shutter that is movable between a closed position in which the shutter covers the opening and an open position in which the shutter does not cover the opening and that, when the developer-supplying container is inserted into the image forming apparatus, comes into contact with a part of the image forming apparatus and is thereby moved from the closed position to the open position, and a paddle that conveys the developer to the opening by rotating about a shaft within the container, the paddle including a first arm that has a shape that is wider on an upstream side in a direction of the rotation of the paddle and narrower toward a downstream side in the direction of the rotation of the paddle such that a narrowest portion of the first arm is located at the same position as the opening in a direction of the shaft, the first arm rotating together with the paddle, the paddle further including two frames joined with each other at the narrowest portion of the first arm, the two frames shaped so that the narrowest portion of the first arm is furthest downstream in the rotation direction of the paddle and so that developer is collected toward the narrowest portion when the paddle is rotated; and the toner cartridge having:

a body that contains toner and includes an opening through which the toner is supplied the image forming apparatus; and a supplying mechanism, provided with the body, that discharges the toner from the opening of the body to the image forming apparatus, wherein the body is removably mounted on the mounting unit of the image forming apparatus through the port.

2. The toner cartridge according to claim 1, wherein the paddle comprises a pair of arms including the first arm and a second arm, and the pair of arms are arranged point-symmetrically as viewed in the direction of the shaft.

3. The toner cartridge according to claim 1, wherein the narrowest portion of the first arm at which the frames are joined with each other is located at a center portion of the paddle in the direction of the shaft.

4. The toner cartridge according to claim 1, wherein the first arm has a V-shape with the narrowest portion of the first arm at which the frames are joined with each other being a vertex.

5. The toner cartridge according to claim 1, wherein the opening is located at a position higher than a bottom of the container in a gravitational direction.

6. The toner cartridge according to claim 1, further comprising a driving mechanism that is, when inserted into the image forming apparatus for supplying the image forming apparatus with the developer, coupled with a driving source provided in the image forming apparatus.

7. The toner cartridge according to claim 1, wherein the body has a same outer shape as a shape of the developer-supplying container to be removably mounted on the mounting unit of the image forming apparatus, when the developer-supplying container is not mounted on the mounting unit.

8. A toner cartridge and a developer-supplying container for use with an image forming apparatus on which the developer-supplying container can be mounted on a mounting unit through a port, the toner cartridge comprising:

a body that contains toner and includes a first opening through which the toner is supplied the image forming apparatus; and a first shutter, provided with the body, that is movable between a first closed position in which the first shutter covers the first opening and a first open position in which the first shutter does not cover the first opening, wherein when the toner cartridge is inserted into the image forming apparatus, the first shutter comes into contact with a part of the image forming apparatus and is thereby moved from the first closed position to the first open position, wherein the body is removably mounted on the mounting unit of the image forming apparatus through the port, the body has a same outer shape as a shape of the developer-supplying container to be removably mounted on the mounting unit, when the developer-supplying container is not mounted on the mounting unit, and the developer-supplying container comprising:

a container that contains the developer and includes a second opening for supplying the image forming apparatus with the developer, a second shutter that is movable between a second closed position in which the second shutter covers the second opening and a second open position in which the second shutter does not cover the second opening and that, when the developer-supplying container is inserted into the image forming apparatus, comes into contact with the part of the image forming apparatus and is thereby moved from the second closed position to the second open position, and a paddle that conveys the developer to the second opening by rotating about a shaft within the container, the paddle including a first arm that has a shape that is wider on an upstream side in a direction of the rotation of the paddle and narrower toward a downstream side in the direction of the rotation of the paddle such that a narrowest portion of the first arm is located at the same position as the second opening in a direction of the shaft, the first arm rotating together with the paddle, the paddle further including two frames joined with each other at the narrowest portion of the first arm, the two frames shaped so that the narrowest portion of the first arm is furthest downstream in the rotation direction of the paddle and so that developer is collected toward the narrowest portion when the paddle is rotated.

9. The toner cartridge according to claim 8, wherein the first opening is located at a position higher than a bottom of the body in a gravitational direction.

10. The toner cartridge according to claim 9, further comprising:

a supplying mechanism, provided with the body, that moves the toner upward from the bottom of the body within the body to discharges the toner from the first opening to the image forming apparatus.

11. The toner cartridge according to claim 8, further comprising:

a driving mechanism provided with the body and that is, when the body is inserted into the image forming apparatus for supplying the image forming apparatus with the toner, coupled with a driving source provided in the image forming apparatus.

12. The toner cartridge according to claim 11, wherein the driving source drives the developer-supplying container when the developer-supplying container is inserted into the image forming apparatus for supplying the image forming apparatus with the developer.

13. The toner cartridge according to claim 8, wherein the first opening is located at a position same as the position of the second opening of the developer-supplying container from which developer contained in the developer-supplying container is discharged to the image forming apparatus.

* * * * *